US006622760B2

(12) United States Patent
Peattie

(10) Patent No.: US 6,622,760 B2
(45) Date of Patent: Sep. 23, 2003

(54) FUELING NOZZLE

(75) Inventor: Adam Robert Peattie, Mt Hutton (AU)

(73) Assignee: Julie Elizabeth Clifton, Merewether (AU)

( * ) Notice: Subject to any disclaimer, the term of this patent is extended or adjusted under 35 U.S.C. 154(b) by 77 days.

(21) Appl. No.: 09/995,867

(22) Filed: Nov. 29, 2001

(65) Prior Publication Data

US 2002/0069934 A1 Jun. 13, 2002

Related U.S. Application Data

(60) Provisional application No. 60/254,892, filed on Dec. 13, 2000.

(51) Int. Cl.[7] ..... B65B 1/30; B65B 3/28; B65B 57/06; B65B 57/14; B67C 3/00

(52) U.S. Cl. ..... 141/224; 141/206; 141/223

(58) Field of Search ..... 141/206, 223, 141/224, 382, 392; 137/495, 505.14

(56) References Cited

U.S. PATENT DOCUMENTS 3,208,486 A * 9/1965 Fromm ..... 141/208

4,314,582 A * 2/1982 Drori ..... 137/495

FOREIGN PATENT DOCUMENTS

AG 47577/99 8/2000

* cited by examiner

*Primary Examiner*—Timothy L. Maust
(74) *Attorney, Agent, or Firm*—Larson & Taylor, PLC

(57) ABSTRACT

A refueling nozzle 100 comprising a housing 102 which is of a "dry breaks" construction. The rear end of the nozzle housing 102 includes a rear chamber 104 in which a piston 106 is housed for axial reciprocation. The refueling nozzle 100 is provided with a spring 118 which operatively cooperates with the piston head 106 so as to urge the valve into the "on" position wherein the refueling nozzle 100 is open. An end cap 109 is fitted to the rear end of the nozzle housing 102 wherein the rear chamber is enclosed. The end cap 109 includes a plurality of spaced apart and coaxial annular grooves such as 122 each being adapted to removably receive a locking element in the form of a C-clip 124 which bears against the flange of a spring retaining element 120 so as to compress the spring 118 against the piston head 106 at the required force. Thus, a user can adjust the biasing force in the spring 118.

6 Claims, 2 Drawing Sheets

FUELING NOZZLE

CROSS REFERENCE TO RELATED APPLICATIONS

This application claims benefit of U.S. Provisional Application No. 60/254,892, filed on Dec. 13, 2000.

FIELD OF THE INVENTION

The present invention relates generally to a refuelling nozzle and relates particularly, although not exclusively, to a refueling nozzle for mining equipment.

BACKGROUND TO THE INVENTION

Australian complete patent application No. 47577/99 describes a refueling nozzle of a "dry break" design. As shown in FIG. 1 the refueling nozzle 1 includes a housing 2 to which a muzzle section 3 is fitted at a forward end and an end cap 4 connected at a rearward end. The housing 2 includes a fuel inlet 5 to which a fuel hose (not shown) is connected, and a fuel outlet 6 formed in the muzzle section 3 of the housing 2. A fuel delivery passageway 7 is formed within the housing 2 between the inlet and outlet 5 and 6, respectively. A retainer 8 is designed to seat about the fuel outlet 6 and is coupled to a piston head 9 via a piston rod 10. The piston head 9 reciprocates within a rearward chamber 11 defined in the housing 2. The piston head 9 is actuated via a cocking handle 12 which pivots about the end cap 4. The cocking handle 12 is coupled to the piston head 9 via link members 13. The refueling nozzle 1 also includes a spring 14 housed within the end cap 4 and arranged to force the piston head 9 together with the piston rod 10 and the retainer 8 clear of the fuel outlet 6. The spring 14 is retained by a spring retaining member 15 which is threadingly fitted within the end cap 4. Screwing of the spring retaining member 15 adjusts the spring force imparted on the piston head 9 by the spring 14. The refueling nozzle 1 mates with a receiver 16 which is connected to a fuel tank (not shown). The receiver 16 includes a poppet valve 17 which is biased against and seals an outlet of the receiver 16. In operation the retainer 8 axially presses against and thus actuates the poppet valve 17 to permit the flow of fuel to the fuel tank.

The refuelling nozzle of Australian complete patent application No. 47577/99 suffers from the following drawbacks associated with the spring retaining member:

i) the force in the spring can unnecessarily and repeatedly be adjusted merely by removing an end fitting of the end cap and rotating the spring retaining member or in the alternative embodiment merely by rotating the spring retaining member through an access port provided in the end cap; and ii) the threaded connection of the spring retaining member may displace over time and thus vary the spring force imparted on the piston head.

SUMMARY OF THE INVENTION

According to the present invention there is provided a refuelling nozzle comprising:

a nozzle housing including a fuel inlet and a fuel outlet between which is disposed a fuel passageway;

a reciprocating valve element being configured to sealably seat about the fuel outlet to prevent the flow of fuel through the fuel passageway;

a piston rod at opposing ends being connected to the reciprocating valve element and a piston, respectively, the piston being slidably housed in a piston chamber defined by the nozzle housing;

a spring being arranged at opposite ends to operatively cooperate with the piston and a spring retaining element, respectively, wherein the spring provides a biasing force to urge the reciprocating element via the piston and the piston rod to unseat from the fuel outlet; and an end cap fitted to the nozzle housing, the end cap being arranged to house the spring and internally including a plurality of spaced apart recesses each being adapted to removably receive a locking element which engages the spring retaining element and, depending on the recess in which the locking element is located, vary the biasing force in the spring.

Preferably the recesses include a plurality of spaced apart annular recesses. More preferably the plurality of annular recesses are each in the form of an annular groove and the locking element is a C-clip which is removably received in one of the grooves. Generally the cap is provided with three or more of the annular grooves.

Typically the spring retaining element is generally cup-shaped and thus configured to locate about one of said opposite ends of the spring. More typically the cup-shaped retaining element includes an outwardly protruding flange which abuts the locking element.

BRIEF DESCRIPTION OF THE DRAWINGS

In order to achieve a better understanding of the nature of the present invention a preferred embodiment of a refueling nozzle will now be described, by way of example only, with reference to the accompanying drawings in which.

DETAILED DESCRIPTION OF THE PREFERRED EMBODIMENT

Figure 1:
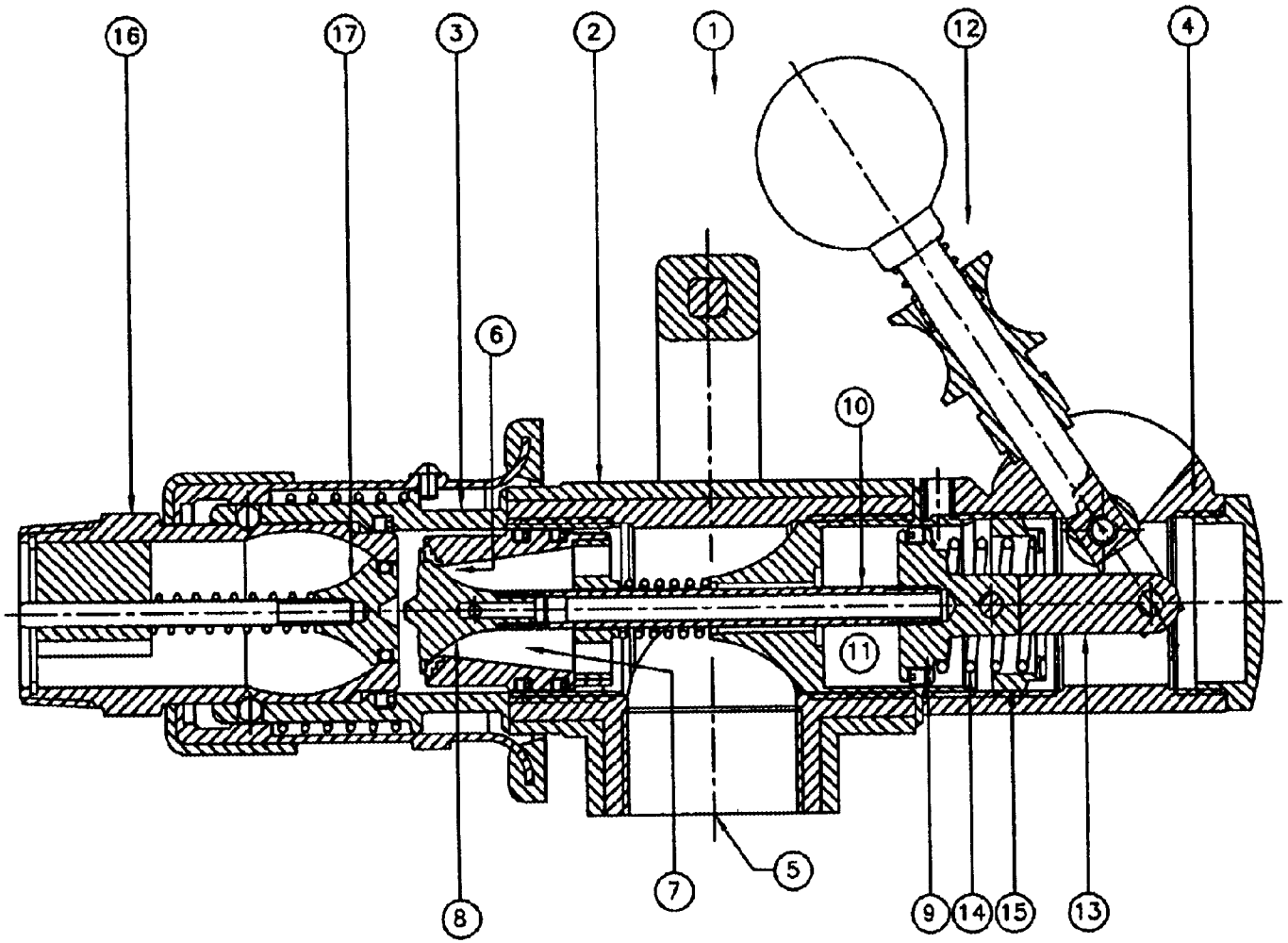
FIG.1 PRIOR ART
FIG. 1 is a schematic cross-sectional view of a conventional refuelling nozzle.
Figure 2:
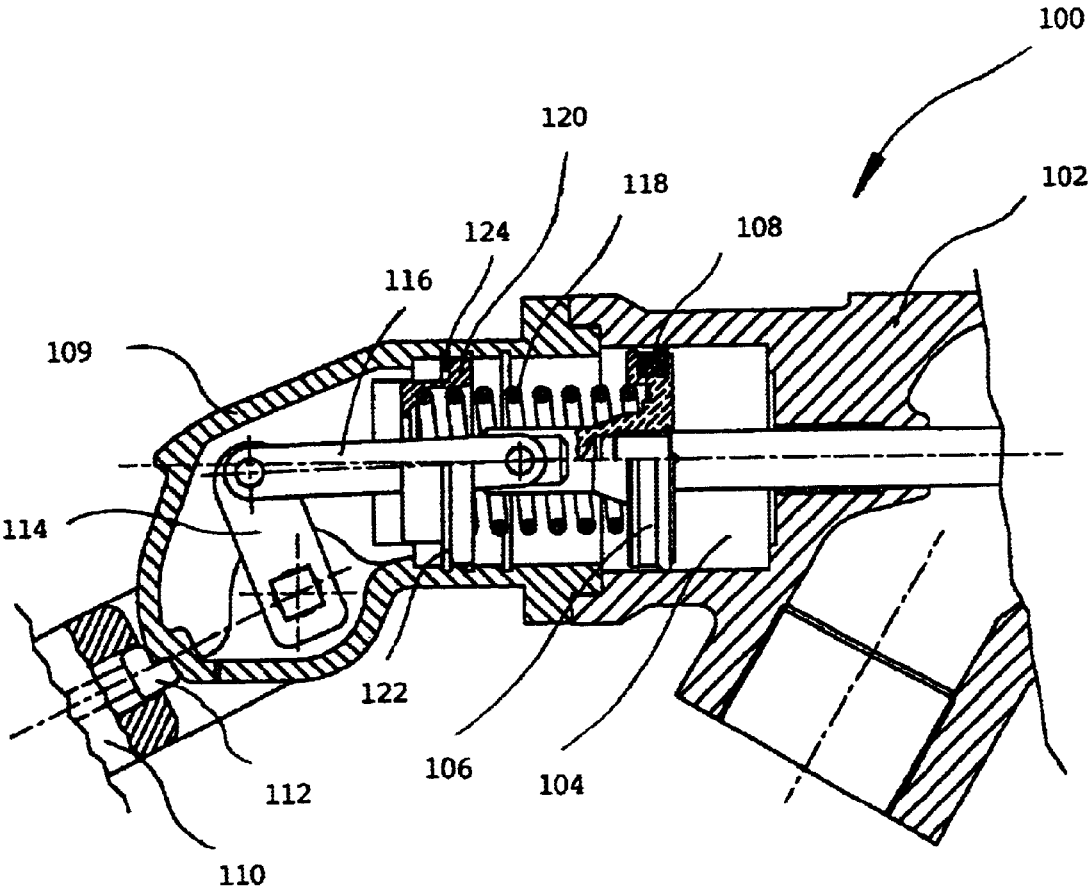
FIG. 2 is a cross-sectional view of part of a refuelling nozzle detailing the nozzle end cap.

As shown in FIG. 2 there is a refuelling nozzle 100 comprising a housing 102 which is similar in construction to that of the acknowledged "dry break" refueling nozzle of Australian complete patent application No. 47577/99. The rear end of the nozzle housing 102 includes a rear chamber 104 in which a piston head 106 is housed for axial reciprocation. The piston head 106 is provided with a piston seal 108 which is seated within an annular groove provided about the piston head 106. An end cap 109 is fitted to the rear end of the nozzle housing 102 wherein the rear chamber 104 is enclosed. The piston head 106 is actuated via an operating handle 110 which is shown in the "off" position wherein a valve element or retainer is seated about a fuel outlet (not shown). The operating handle 110 is provided with a catch 112 which retains the handle 110 in the "off" position only. The operating handle 110 rotates about the end cap 109 and is keyed to a lever arm 114 which is coupled to the piston head 106 via a pair of parallel link arms 116. Thus, rotation of the operating handle 110 effects movement of the piston head 106 and the retainer from the "off" to the "on" positions wherein the valve is closed or opened, respectively.

Importantly, the refueling nozzle 100 is provided with a spring 118 which operatively cooperates with the piston head 106 so as to urge the poppet valve into the "on" position wherein the refueling nozzle 100 is open. The spring 118 maintains the handle 110 and the piston head 106 in the "on" position. The spring 118 is generally elongate and at one end bears against the piston head 106 whilst an opposite end is retained by a spring retaining element 120. The spring retaining element 120 is in this embodiment generally cup-shaped and includes an outwardly protruding flange which is shaped complementary to and rests within a corresponding internal surface of the end cap 109. The cup-shaped retaining member 120 is shaped wherein the opposite end of the spring 118 nests within the retaining member 120. Additionally, the cup-shaped retaining member 120 includes an enlarged opening through which the links 116 pass with adequate clearance.

The end cap 109 includes a plurality of spaced apart recesses such as 122 formed internally adjacent the spring retaining element 120. The recesses 122 in this embodiment are in the form of three (3) spaced apart and coaxial annular grooves. The annular grooves such as 122 are each adapted to removably receive a locking element which in this example is in the form of a C-clip 124. The C-clip such as 124, which is retained in one of the annular grooves such as 122, bears against the flange of the spring retaining element 120 so as to compress the spring 118 against the piston head 106 at the required force. The three (3) "settings" allow a user to adjust the biasing force in the spring 118 which unseats the valve element or retainer from the fuel outlet. Thus, a user can "tune" the level of tank pressurization required for closure of the refueling nozzle 100. Additionally, the spring 118 may be provided with varying stiffness whereby selection of a spring and annular groove setting for the C-clip provides a range of available "settings".

Now that a preferred embodiment of the present invention has been described in some detail, it will be apparent to those skilled in the art that the refueling nozzle has at least the following advantages over the admitted prior art:

i) the refuelling nozzle is essentially tamper proof wherein adjustment of the spring retaining element can only be effected by complete removal of the end cap from the nozzle housing; and ii) the locking element together with the spring retaining element provide for rigid location of the spring, particularly under conditions of vibration and repetitive use.

Those skilled in the art will appreciate that the invention described herein is susceptible to variations and modifications other than those specifically described. For example, the locking element need not be restricted to the C-clip described but rather may extend to other appropriate mechanisms such as a series of circumferentially spaced grub screws. Additionally, the recesses formed internally in the end cap may extend to threaded or unthreaded apertures and may in fact be formed in the housing rather than the end cap. Although the refuelling nozzle has been described in the context of a "dry break" system it may also extend to application in a "splash fill" system. Furthermore, the invention is particularly suited to adaption of the "dry break" refuelling nozzles of Australian patent No. 586085 and U.S. Pat. No. 4,919,174.

All such variations and modifications are to be considered to be within the scope of the present invention, the nature of which is to be determined from the foregoing description.

What I claim is:

1. A refueling nozzle comprising:

a nozzle housing including a fuel inlet and a fuel outlet between which is disposed a fuel passageway;

a reciprocating valve element being configured to sealably seat about the fuel outlet to prevent the flow of fuel through the fuel passageway;

a piston rod at opposing ends being connected to the reciprocating valve element and a piston, respectively, the piston being slidably housed in a piston chamber defined by the nozzle housing;

a spring being arranged at opposite ends to operatively cooperate with the piston and a spring retaining element, respectively, wherein the spring provides a biasing force to urge the reciprocating element via the piston and the piston rod to unseat from the fuel outlet; and an end cap fitted to the nozzle housing, the end cap being arranged to house the spring and internally including a plurality of spaced apart recesses each being adapted to removably receive a locking element which engages the spring retaining element and, depending on the recess in which the locking element is located, vary the biasing force in the spring.

2. A refueling nozzle as defined in claim 1 wherein the recesses include a plurality of spaced apart annular recesses.

3. A refueling nozzle as defined in claim 2 wherein the plurality of annular recesses are each in the form of an annular groove and the locking element is a C-clip which is removably received in one of the grooves.

4. A refueling nozzle as defined in claim 3 wherein the cap is provided with three (3) or more of the annular grooves.

5. A refueling nozzle as defined in claim 1 wherein the spring retaining element is generally cup-shaped and thus configured to locate about one of said opposite ends of the springs.

6. A refueling nozzle as defined in claim 5 wherein the cup-shaped retaining element includes an outwardly protruding flange which abuts the locking element.

* * * * *